US007114296B2

(12) United States Patent
Klassen et al.

(10) Patent No.: US 7,114,296 B2
(45) Date of Patent: Oct. 3, 2006

(54) TEMPORARY BRACING SYSTEM FOR INSULATED WALL FORM AND METHOD

(75) Inventors: Glen A. Klassen, Winnipeg (CA); Glenn R. Scott, Dundalk (CA)

(73) Assignee: ARXX Building Products, Inc., Cobourg (CA)

( * ) Notice: Subject to any disclaimer, the term of this patent is extended or adjusted under 35 U.S.C. 154(b) by 575 days.

(21) Appl. No.: 09/984,668

(22) Filed: Oct. 30, 2001

(65) Prior Publication Data

US 2003/0079420 A1 May 1, 2003

(51) Int. Cl.
*E04G 21/04* (2006.01)
*E04G 21/26* (2006.01)

(52) U.S. Cl. ..... 52/127.2; 52/426; 52/432; 52/745.12; 52/351

(58) Field of Classification Search ..... 52/127.2, 52/426, 432, 699, 745.12, 127.1, 351, 353, 52/422, 425, 431, 435; 249/211, 219.2, 219.1, 249/190, 189; 264/35
See application file for complete search history.

(56) References Cited

U.S. PATENT DOCUMENTS

| | | | | |
|---|---|---|---|---|
| 1,597,424 | A | | 8/1926 | Bennetts |
| 1,769,292 | A | | 7/1930 | Hodapp |
| 1,963,980 | A | | 6/1934 | Garrett |
| 2,820,678 | A | | 1/1958 | Huber |
| 2,882,101 | A | | 4/1959 | Michalak et al. |
| 3,084,761 | A | | 4/1963 | Robertson |
| 3,215,392 | A | | 11/1965 | Fisher et al. |
| 3,679,026 | A | | 7/1972 | Hansen et al. |
| 3,791,486 | A | | 2/1974 | Marnoch |
| 3,858,837 | A | | 1/1975 | Merritt |
| 3,991,969 | A | | 11/1976 | Oxyer |
| 3,998,294 | A | | 12/1976 | Moeller |
| 4,068,427 | A | * | 1/1978 | Camardo ..... 52/127.2 |
| 4,070,833 | A | * | 1/1978 | Hancock ..... 52/148 |
| 4,079,556 | A | | 3/1978 | Luck et al. |
| 4,085,495 | A | | 4/1978 | Hebert |
| 4,145,024 | A | | 3/1979 | Ward |
| 4,166,603 | A | | 9/1979 | Ward |
| 4,333,289 | A | | 6/1982 | Strickland |
| 4,373,314 | A | | 2/1983 | Allan |
| 4,430,839 | A | | 2/1984 | Butters |
| 4,597,472 | A | | 7/1986 | Hjelm |
| 4,643,388 | A | | 2/1987 | Tazawa |
| 4,673,060 | A | | 6/1987 | Gregory |

(Continued)

*Primary Examiner*—Carl D. Friedman
*Assistant Examiner*—Chi Q. Nguyen
(74) *Attorney, Agent, or Firm*—McGuireWoods LLP

(57) ABSTRACT

A system and method for securing an insulated concrete wall form to a bracing structure such as a scaffolding frame to keep the form straight and plumb during construction. The system uses anchoring and tensioning members, which may be formed as pieces separate or integrally as a single piece to hold the bracing structure against insulated panels of the insulated concrete wall form. Openings may be cut through the insulated panels to provide a pathway for the tensioning member. The anchoring member is positioned against an inner face of the insulated panel. A portion of the anchoring member or the tensioning member extends into the wall form concrete receiving space to fix the system in place once the concrete sets. The tensioning member may be disposed through one of the openings, around the bracing structure and through the other opening and around the anchor member to maintain the tension. Alternatively, the tensioning member may be disposed through an interface between upper and lower wall form blocks. The bracing structure may be adjusted to align the wall form vertically.

37 Claims, 15 Drawing Sheets

U.S. PATENT DOCUMENTS 4,830,144 A 5/1989 Werner
4,835,928 A 6/1989 Scott
4,850,453 A 7/1989 St-Germain
4,872,298 A 10/1989 Klemic, Jr.
4,888,931 A 12/1989 Meilleur
4,891,926 A 1/1990 Allenbaugh
4,901,403 A 2/1990 Larsen
4,903,795 A 2/1990 Cummings
4,938,449 A 7/1990 Boeshart
4,967,528 A 11/1990 Doran
4,996,770 A 3/1991 McCracken
5,038,541 A 8/1991 Gibbar, Jr.
5,040,344 A 8/1991 Durand
5,065,561 A 11/1991 Mason
5,159,993 A 11/1992 St-Germain
5,343,667 A 9/1994 Peden
5,388,663 A 2/1995 Phillippe et al.
5,390,459 A 2/1995 Mensen
5,465,542 A 11/1995 Terry
5,488,806 A 2/1996 Melnick et al.
5,492,303 A * 2/1996 Jaruzel ..... 249/4
5,570,550 A 11/1996 Roby
5,572,838 A 11/1996 Truitt et al.
5,575,938 A 11/1996 Ono
5,649,401 A 7/1997 Harrington, Jr.
5,657,600 A 8/1997 Mensen
5,664,382 A 9/1997 Melnick et al.
5,670,076 A 9/1997 Leek
5,704,180 A 1/1998 Boeck
5,771,648 A 6/1998 Miller et al.
5,809,727 A 9/1998 Mensen
5,810,114 A 9/1998 White
5,845,445 A 12/1998 Blackbeard
5,956,922 A * 9/1999 Liuska ..... 52/745.09
5,987,830 A 11/1999 Worley
5,992,114 A * 11/1999 Zelinsky et al. ..... 52/426
5,996,856 A 12/1999 Duncan
6,065,254 A 5/2000 Lanka
6,112,475 A * 9/2000 Truitt ..... 52/127.2
6,250,024 B1 6/2001 Sculthorpe et al.
6,539,677 B1 * 4/2003 Lanka ..... 52/127.2
2002/0073634 A1 * 6/2002 Bolinger ..... 52/127.2

* cited by examiner

TEMPORARY BRACING SYSTEM FOR INSULATED WALL FORM AND METHOD

BACKGROUND OF THE INVENTION

1. Field of the Invention

The invention relates generally to insulated concrete form ("ICF") wall bracing, and more particularly, to a system and method for bracing an insulated concrete wall form to a support/bracing structure to align and support the ICF wall during construction.

2. Description of the Related Art

Conventional building construction utilizes concrete walls that are normally produced by constructing form walls, pouring concrete into the space between the walls and, upon setting of the concrete, removing the form walls. A conventional concrete form wall is disclosed in U.S. Pat. No. 4,333,289 to Strickland. The form wall includes a pair of spaced opposed panels made from plywood and defining therebetween a space into which fluid concrete is poured in forming the wall. Horizontally spaced vertical stiffeners or strongbacks are provided outwardly of each plywood panel to provide major strengthening for the panel support structure. Elongate beams or walers are also provided to extend horizontally along the outer side of each panel. An outwardly opening pocket formed as part of the waler retains a wooden nailer to which the plywood form panel can be nailed, screwed or otherwise fastened to the waler.

Another system for temporarily attaching a reinforcing beam to a poured concrete structural member is shown in U.S. Pat. No. 5,572,838 to Truitt et al. An insert is adapted to be set in the poured concrete member. The insert has a body that creates a void in the concrete structural member and leg members that are partially set in the poured concrete with portions thereof extending through the body of the insert so as to be free of concrete. A special bolt engages with the leg members and provides a means for securing a reinforcement beam to the concrete structural member.

More recent building systems involve the use of insulated concrete forms (ICFs), which use a foam insulating material to construct permanent concrete form walls. The form walls are typically constructed by placing separate building components (also known as form blocks) upon each other. The concrete is then poured and the form walls are left in place after the concrete hardens to become a permanent part of the wall. Advantages provided by the use of ICFs include a reduction in the number of operations normally associated with building construction and generally the elimination of a need to provide further insulation. An example of particularly advantageous types of ICFs appears in U.S. Pat. Nos. 5,390,459; 5,657,600; and 5,809,727 to Mensen (Mensen), the disclosures of which are incorporated by reference herein in their entirety. In general, the ICFs taught by Mensen are made from a building component or block that includes first and second foam side panels. The side panels are preferably made of expanded polystyrene and are arranged in spaced parallel relationship with their inner surfaces facing each other. Plastic bridging members hold the side panels together against the forces applied by the fluid concrete. Each bridging member includes end plates, which may be arranged to line up when the components are stacked to form furring strips for attachment of finishing materials.

With the advent of the use of stay-in-place forms or permanent concrete form work, such as ICFs, there is a need in the building construction art for an efficient, cost-effective and reliable system and method to support the building components that make up the ICFs against construction loads, and to align the walls during construction. The insulated side panels of an ICF do not provide a strong surface to which reinforcing beams can be easily attached, as with plywood side panels. Commercial, institutional and industrial buildings often require walls higher than 8 to 12 feet (hereinafter referred to as "tall walls") in order to incorporate machinery, warehousing and high wall assemblies. Wall forms used in pouring in place such high vertical walls must be supported against various construction loads including wind loads, alignment loads, scaffold loads, and loads created by the hydrostatic pressure of the fluid concrete poured into the wall forms. Falsework is the construction industry term for structural supports and the necessary bracing required for the temporary support of loads during construction. Existing means for attaching strongbacks or reinforcing beams to wall forms do not lend themselves to attachment to insulated panels on ICFs as they do to conventional falsework.

Existing bracing systems used in ICF wall construction also do not adequately address the problems of supporting and controlling ICFs during construction, particularly in high wall applications of ICF (such as when the ICF is used to construct a wall of greater than 12 feet in height).

Accordingly, a bracing system such as shown in FIG. 1 has been used in ICF wall construction. This known system includes a vertical box channel 120 that is connected to the ICF blocks before they are filled with concrete using screws 122 that pass through the box channel 120 and into exposed end plates 124 of the plastic bridging members in the ICF blocks. As discussed above, the end plates 124 of each bridging member in the ICF blocks may be arranged to line up when the ICF blocks are stacked. The resulting "furring strip" provides the support for the vertical box channel 120. A two-piece diagonal bracing pole 130 is joined at the threaded ends of each piece of the pole by a turnbuckle 132, which allows for adjustments in the length of pole 130. The diagonal pole is attached to the ground or sub-floor at one end 130', and to the box channel 120 at the opposite end 130". A standard scaffold angle 140 is also attached to the vertical box channel 120 to support scaffolding upright 150 and planks 152. Adjustments in the length of diagonal pole 130 by turning turnbuckle 132 result in end 130" of pole 130 either pushing or pulling on vertical box channel member 120, thus affecting the angle of the wall formed from the stacked ICF blocks. A disadvantage of this type of alignment system is that it requires the step of screwing a structural member such as vertical box channel 120 into the furring strips 124 in order to provide a member for transferring loads such as wind loads from the ICF wall to bracing members such as diagonal pole 130. Furthermore, this system has height limitations, imposed by the length of the box channel.

Other bracing systems may be used in ICF wall construction such as the bracing system disclosed in U.S. Pat. No. 6,250,024 to Sculthorpe et al., which is commonly assigned with this application. The bracing system disclosed in this patent includes an anchoring member adapted to be set in pourable building material received in the wall form and supported by the bridging member extending between the ICF form walls. A flexible tensioning member may be wrapped around the anchoring bar to secure a bracing member to the ICF form. While the bracing system of Sculthorpe et al. is advantageous, the anchoring member typically is supported by the bridging members and generally spans the distance between two or more bridging members. Moreover, the location of the anchoring member then is limited by the location of the bridging members.

Hence, the foregoing discussion shows that there is a need for a temporary bracing system capable of supporting and aligning ICF walls during construction, particularly in tall wall applications, that can be more easily, reliably and efficiently used with a variety of falsework systems than heretofore possible.

SUMMARY OF THE INVENTION

The invention solves the problems and avoids the disadvantages of the prior art by providing a system and method for efficiently and effectively bracing an ICF to a variety of falsework systems and aligning the ICF. The system should provide adequate structure to transfer a portion or all of the construction loads on the ICF to the falsework. One of those loads, wind loads, increases with height above ground and varies depending upon factors such as geographic location, proximity to open areas and wind tunneling effect of adjacent structures. Conventional structural design generally requires that construction bracing of tall walls be kept in place until the top edges of the walls are supported laterally such as by a roof structure. The pouring of concrete into the wall forms also creates an alignment load that should be compensated for in order to maintain the poured wall in a vertical position. The hydrostatic pressure created by fluid concrete being poured into the wall form is carried by and retained by panels and connecting structure within the ICF. If the pouring of concrete into the wall form is not done in stages to allow the concrete to start to set before the height of fluid concrete becomes too great, hydrostatic pressure would become more significant as the height of the wall is increased or the rate of pouring is increased. An excessive rate of pouring of concrete could result in a "blow out" of the insulation panels on the ICF.

In a first aspect of the invention, these problems are solved by providing a system for temporarily bracing an insulated wall form having generally parallel spaced panels, at least one of which is formed from insulating material having outside and inside faces. A bracing member is disposed adjacent to the outside face of the insulating panel and adapted to support the insulated wall form. A tensioner has a first portion disposed against a portion of the inside face of the insulating panel and a second portion securing the bracing member and the insulating panel together to align and brace the wall form.

In a first embodiment, the first portion of the tensioner may be an anchoring member having a plate with a flat portion disposed against the inside face of the panel and a projection disposed to be set in pourable building material received in the wall form. The second portion of the tensioner may be a flexible member such as a wire or strap extending through one or more openings in the insulated wall form or through an interface between upper and lower blocks of the wall form and have ends that are attached around the bracing member.

In a second embodiment, the first portion of the tensioner may be a plate disposed against the inside face of the insulating panel and the second portion of the tensioner may be a flexible member having a portion disposed to be set in pourable building material received in the insulated wall form. The plate may have openings designed to engage and hold barbs formed on the ends of the flexible member to maintain tension on the flexible member when connected to the bracing member. Again, the flexible member may extend through one or more openings in the insulating panel or through an interface between upper and lower form blocks of the insulated wall form.

In third and fourth embodiments, the tensioner may be formed from a single flexible member, such as a metal wire or rod, that carries out the anchoring and tensioning functions of the invention. In the third embodiment, the first portion of the tensioner comprises a portion of the flexible member that extends generally horizontally across the inside face of the insulating panel, and the second portion of the tensioner comprises a portion of the flexible member that loops around the bracing member. The flexible member may have a third portion disposed to be set in pourable building material, e.g., concrete, received in the wall form. Again, the flexible member is positioned through holes or an interface between blocks in the wall form and manipulated into position maintaining the wall form and bracing member in snug engagement.

The fourth embodiment functions similarly to the first, but the first portion of the tensioner comprises a portion of the flexible member that extends generally vertically, instead of horizontally, across the inside face of the insulating panel. In addition, portions of the flexible member may be fixedly attached together, e.g., by welding, to help resist deformation during use.

The bracing member may be an open-top scaffolding frame or other scaffolding frame, and include an alignment member disposed diagonally or otherwise in the scaffolding frame for adjusting the vertical alignment of the insulated wall form. The alignment member may be spaced from the scaffolding frame to allow adjustment without interference from the wall form. The bracing member may be a scaffolding attachment member, which is adjustable in width to align the wall form substantially vertically and disposed between the insulated wall form and a scaffolding frame.

The bracing member may be a system scaffold having interconnection members configured to allow positioning of a leading edge of the system scaffold in close proximity to the outside face of the wall form. The interconnection members may be rosettes having perimeters that define a curved arc portion and a straight portion, where the straight portion is disposed adjacent to the outside face of the wall form.

In another aspect of the invention, a method is provided for temporarily bracing an insulated wall form, in which the following steps are performed. A bracing member is positioned adjacent to an outer face of an insulated wall form having generally parallel spaced panels, at least one of which is formed from insulating material. An interface member is positioned adjacent to an inner face of the insulated wall form opposite the bracing member. A tension member is disposed between the bracing member and the interface member, and a portion of the interface or tension member is positioned to be set in pourable building material received in the wall form. The tension member is tensioned to secure the interface member, wall form and bracing member together to align and brace the wall form.

The tensioning step may include the step of securing the ends of the tension member in a position maintaining the tension between the interface member and bracing member, such as securing the ends together or to the interface member.

The tension member may be positioned through at least one opening in the insulated wall form or in an interface between upper and lower insulated wall form blocks. The interface member and the tension member may be integrally formed as a single piece, which may be manipulated between the innerface of the wall form and the bracing member to carry out the tensioning step.

The method for temporarily bracing an insulated wall form of the invention may include the steps of aligning the wall form in a substantially vertical orientation, filling the wall form with a pourable building material, and allowing the pourable building material to substantially set. To build a tall wall in stages, further steps may include positioning a second wall form on top of the first wall form, positioning a second bracing member above and connecting it to the first bracing member, positioning a second interface member adjacent to an inner face of the second wall form opposite the second bracing member, disposing a second tension member between the second bracing member and the second interface member to secure the second bracing member to the second wall form, and aligning the succeeding wall form in a substantially vertical orientation. These steps may be repeated as necessary to build even higher walls.

The system provides an inexpensive, relatively easy to install bracing structure that supports the ICF against loads imposed during construction and before a roof or other lateral support is in position across the top edges of the finished walls, as well as a simple and effective method for maintaining the ICFs straight and plumb during construction.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of the specification, illustrate preferred embodiments of the invention and together with the detailed description below serve to explain the principles of the invention. In the drawings:

FIG. 2*a* is a perspective view of a first embodiment of an anchoring member made in accordance with the principles of the invention.

FIG. 2*b* is a plan view of the anchor member of FIG. 2*a*.

FIG. 2*c* is a partial cross section view of a wall bracing system using the anchor member of FIG. 2*a*.

FIG. 7*a* is a plan view of a second embodiment of an anchoring member of the invention, which is formed as a flat plate.

FIG. 7*b* is a plan view of a flexible strap tensioning member of the invention designed for use with the anchor plate of FIG. 7*a*.

FIG. 8*a* is a partial cross-sectional plan view of the integral anchoring and tensioning member of the invention.

FIG. 8*b* is a partial cross-section side elevation view of the third embodiment of the invention.

FIG. 8*c* is a front elevation view of the third embodiment of the invention.

DETAILED DESCRIPTION OF THE PREFERRED EMBODIMENTS

Figure 1:
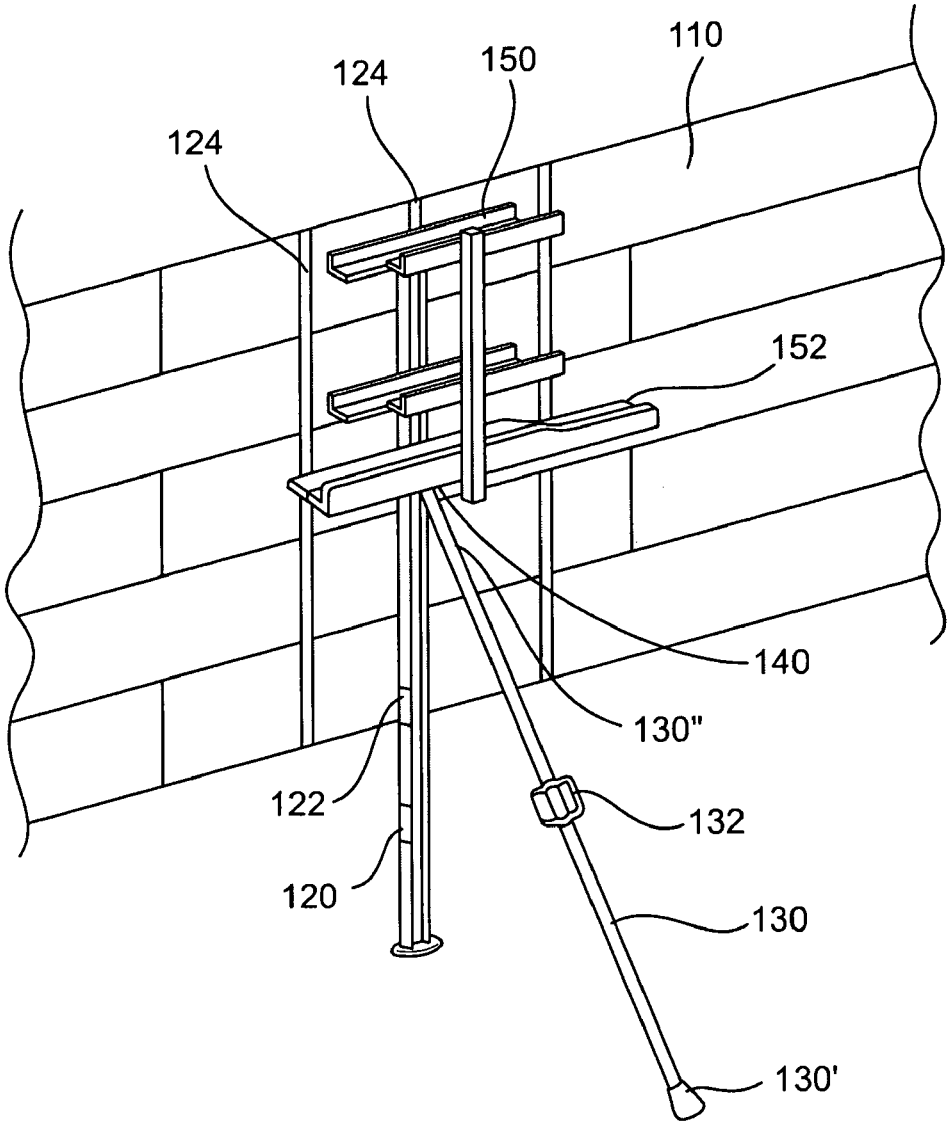
FIG. 1 PRIOR ART
FIG. 1 is a perspective view of a conventional Insulated Concrete Form ("ICF") wall bracing system.
Figure 2A:
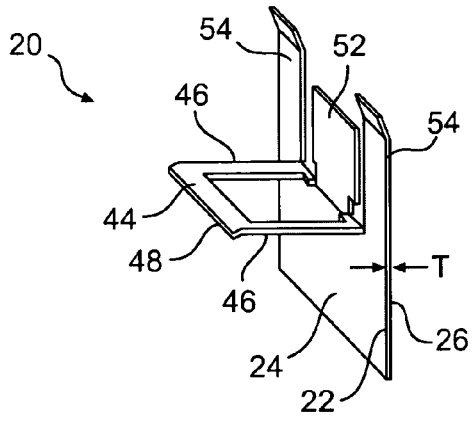
FIGS. 2*a–c* illustrate a first embodiment of the ICF wall bracing system of the invention. More particularly.
Figure 2B:
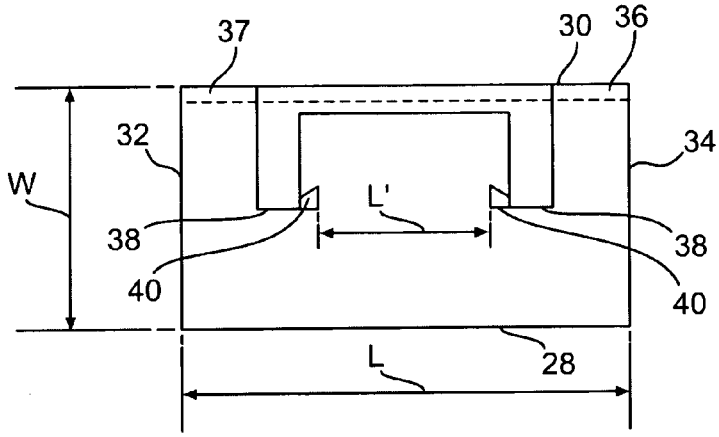
Figure 2C:
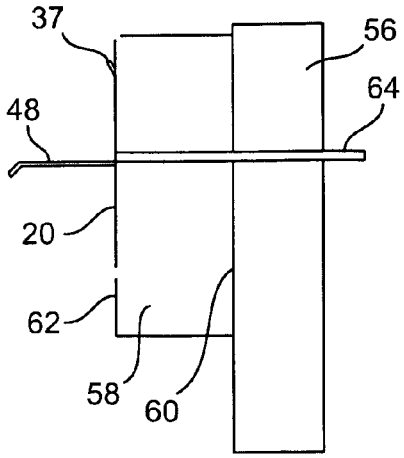
Figure 3:
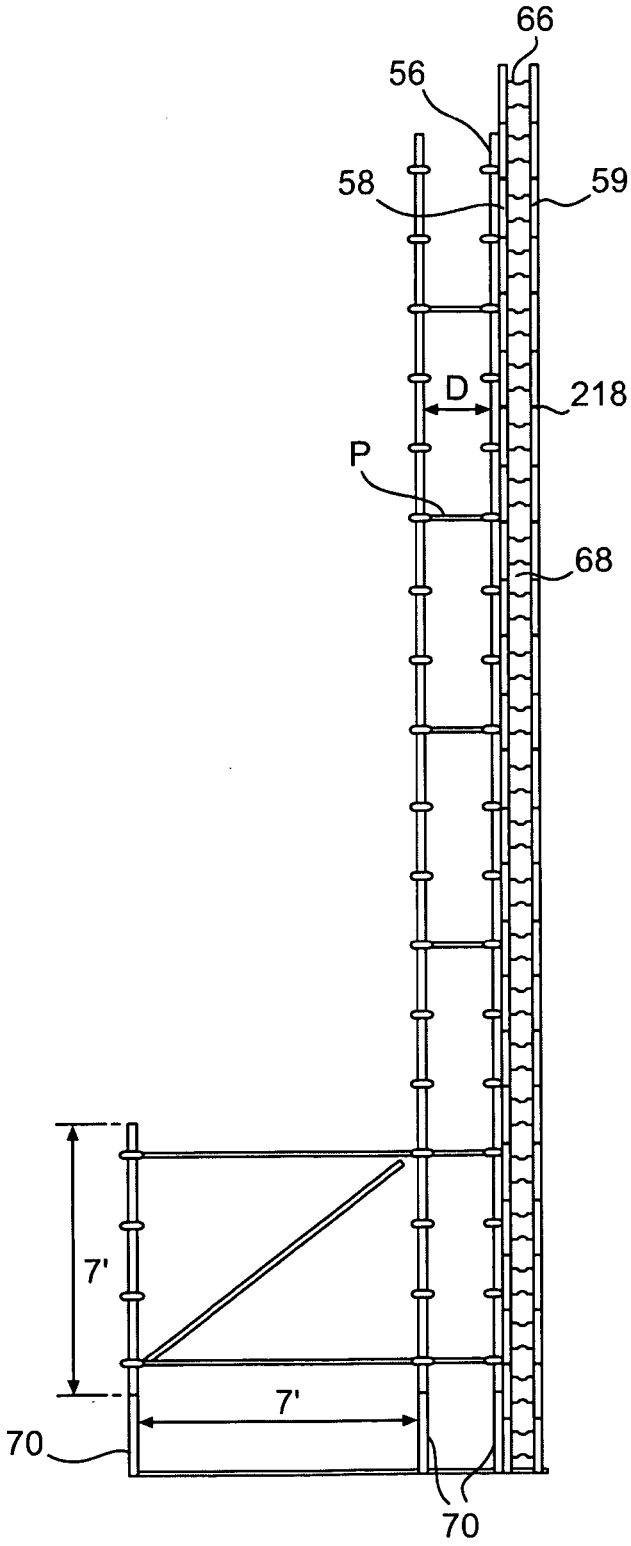
FIG. 3 is a partial cross section view of a wall bracing system made in accordance with the principles of the invention, with system scaffolding and a vertical adjustment member.

Reference will now be made in detail to preferred embodiments of the invention, examples of which are illustrated in the accompanying drawings. FIG. 2*a*, FIG. 2*b* and FIG. 2*c* are perspective, plan, and partial cross section views of a wall bracing system made in accordance with the principles of the invention, including the anchor member. FIG. 3 is a partial cross section view of a wall bracing system made in accordance with the principles of the invention, with system scaffolding and vertical adjustment members. An ICF wall is made from first and second parallel and spaced side panels 58, 59 of the type preferably made from expanded polystyrene as shown in FIG. 3 and described in more detail in U.S. Pat. Nos. 5,390,459; 5,657,600 and 5,809,727, the disclosures of which have been incorporated by reference herein in their entirety. The ICF wall is generally formed in convenient sized building components (also known as blocks) that can be stacked on each other to form a wall. The upper surface of a lower block may be stacked on the lower surface of an upper block to form an interface joint therebetween such as shown schematically at 218 in FIG. 3. Web members 66 extend between and connect insulating panels 58, 59 of individual ICF blocks together, e.g. by being molded into the panels, to resist forces applied by poured concrete. The bracing system of the invention could be used with any other conventional ICF systems including plank or panel ICF systems. Plank or panel ICF systems include form units that must be assembled on-site, in contrast to block systems, such as discussed in this application, which are individual units factory-assembled into blocks.

An anchoring member, such as anchor 20, is provided within the ICF wall to attach the wall to falsework or scaffolding during construction. A primary function of anchor 20 is to distribute loads from the bracing system across an inner face 62 of insulating panel 58. As seen in FIG. 2*a*, anchor 20 includes base plate 22 and tab 48. Plate 22 has front 24, back 26, side edges 32, 34, bottom edge 28 and top edge 30. Crease 36 is formed along an axis parallel to and inward from top edge 30 and defines a bottom edge of bent portion 37. Bent portion 37 serves to strengthen anchor 20. Tab 48 is cut from an upper portion of plate 22 such that tab arms 46, 46 and joiner 44 extending between the tab arms are defined by cuts in plate 22. Plate portions 38, 38 may be stamped to weaken plate 22 at a base of tab arms 46, 46 and facilitate field bending of tab 48 perpendicularly outward from front 24 of plate 22, leaving side upper plates 54, 54 and central upper plate 52 coplanar with a bottom portion of plate 22. Notches 40, 40, separated by a distance L', may be cut from plate 22 at the base of tab arms 46, 46 to receive a tension member as described herein. Anchor 20 is preferably a steel or aluminum alloy plate having a length L, a width W, and a thickness T. Typical dimensions for L, L', W and T may be 5½ inches, 2 inches, 3 inches and 0.050 inches respectively. Of course, other dimensions may be used depending upon the particular application and other factors that are readily known to those skilled in the art.

A bracing member 56 is used to keep ICF 68 straight and plumb during construction, and may be selected from any conventional falsework or scaffolding frame. Bracing member 56 is positioned with its inner side against the outer face 60 of insulating panel 58.

After ICF 68 is positioned against bracing member 56, anchor 20 is oriented so that back 26 is flush with inner face 62 of insulating panel 58 and positioned opposite of bracing member 56. A tension member, such as wire 64 is then routed around the bottom of central upper plate 52 through tension member notches 40, 40, through holes cut through insulating panel 58, and around bracing member 56. Ends of wire 64 are drawn tight and crimped or twisted together, thus drawing bracing member 56 against the outer face 60 of insulating panel 58 and drawing anchor 20 snug against inner face 62 of insulating panel 58, with tab 48 extending perpendicularly inward within a space located between insulating panels 58, 59 for receiving pourable building material such as concrete. Tab 48 helps fix the system in place once the concrete sets. Alternatively, instead of making holes in insulating panel 58, wire 64 may be routed around a base end of central upper plate 52 through tension member notches 40, 40, through an interface joint 218 (see FIG. 3) between upper and lower insulating panels 58 of upper and lower ICF blocks, and around bracing member 56, or in any other manner that provides the desired snug fit between the bracing member and insulating panel. In any case, it is preferred that the bracing member 56 be drawn flush against the outer face 60 and the anchor be drawn flush against inner face 62.

In a preferred embodiment of the invention, bracing member 56 is a scaffolding frame member. FIG. 3 illustrates a system scaffolding frame serving as the bracing member 56 for the ICF wall alignment system of the invention. As shown in FIG. 3 and FIG. 4*b*, the system scaffolding is constructed with sufficient depth to accommodate one working plank P. However, the system scaffolding could be constructed to accommodate two or more planks placed side by side to increase the depth D of the working space accordingly. Insulating wall form 68 has generally parallel spaced insulating panels 58 and 59 connected by web members 66 as described above. An inner frame member of the system scaffolding is positioned adjacent to an outer face of insulating panel 58 and is held tight to the outer face utilizing the above described ICF wall alignment system of the invention. The system scaffold may have vertical alignment members 70 positioned in vertical frame members of the system scaffolding for adjusting the vertical alignment of the system scaffolding and thus the ICF wall coupled thereto. A desired adjustment of the vertical alignment of the ICF wall may be accomplished by adjusting the axial length of vertical adjustment members 70. For example, member 70 farthest from the ICF wall in FIG. 3 could be lengthened while the length of member 70 closest to the ICF wall remains unchanged. In this manner, the angle of the systems scaffold and attached ICF wall relative to the vertical plane may be adjusted. Vertical alignment members 70 may be located in the first stage frame members, as shown in FIG. 3, or they could be located in one or more of the frame members of any other stage of the system scaffolding.

Figure 3A:
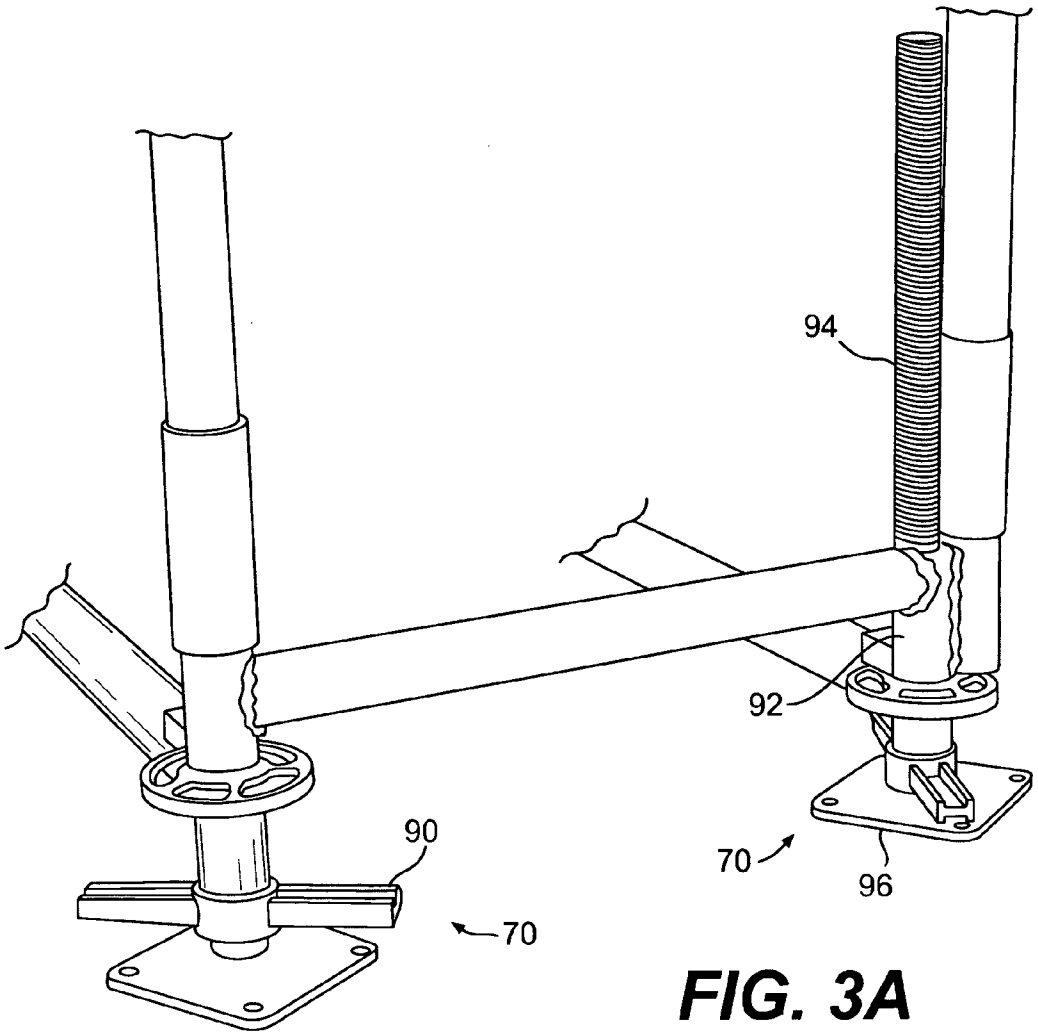
FIG. 3*a* is a perspective view of the vertical adjustment member of FIG. 3.

Referring to FIG. 3*a*, vertical adjustment member 70 may include a screw-jack mechanism such as screw member 94, screw housing 92, threaded wing nut 90 and foot plate 96. The scaffolding frame vertical alignment, and thus the ICF wall vertical alignment may be adjusted by turning wing nut 90, which forces housing 92 to travel vertically along screw member 94. Vertical adjustment member 70 nearest the ICF wall form may be disposed sufficiently outward from the scaffolding frame member that is positioned adjacent to the ICF wall such that wingnut 90 may be turned without interfering with the ICF wall form. Of course, other jacking mechanisms may be used depending upon the particular application and other factors that are readily known to those skilled in the art.

Figure 4:
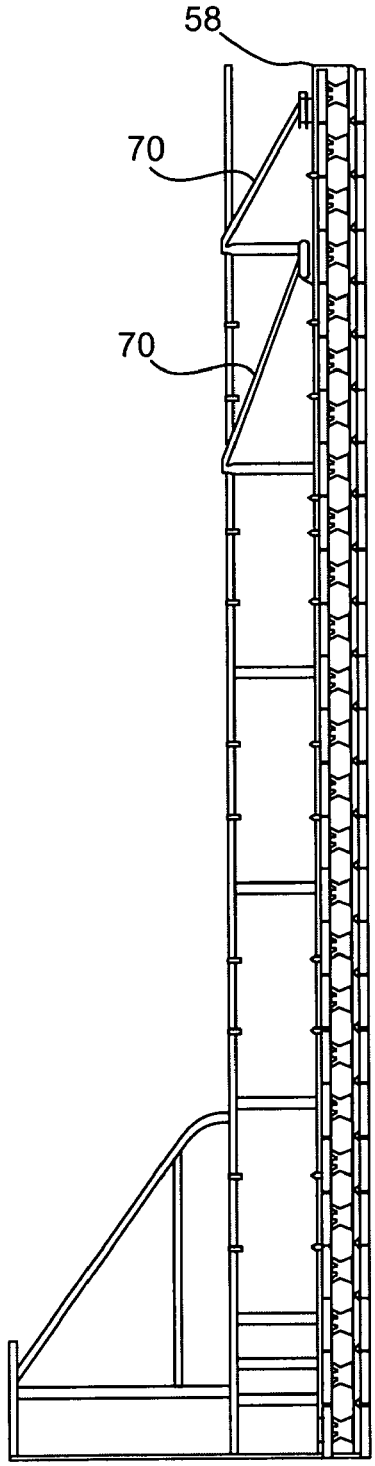
FIG. 4 is a partial cross section view of a wall bracing system made in accordance with the principles of the invention, with system scaffolding and a diagonal adjustment member.
Figure 4A:
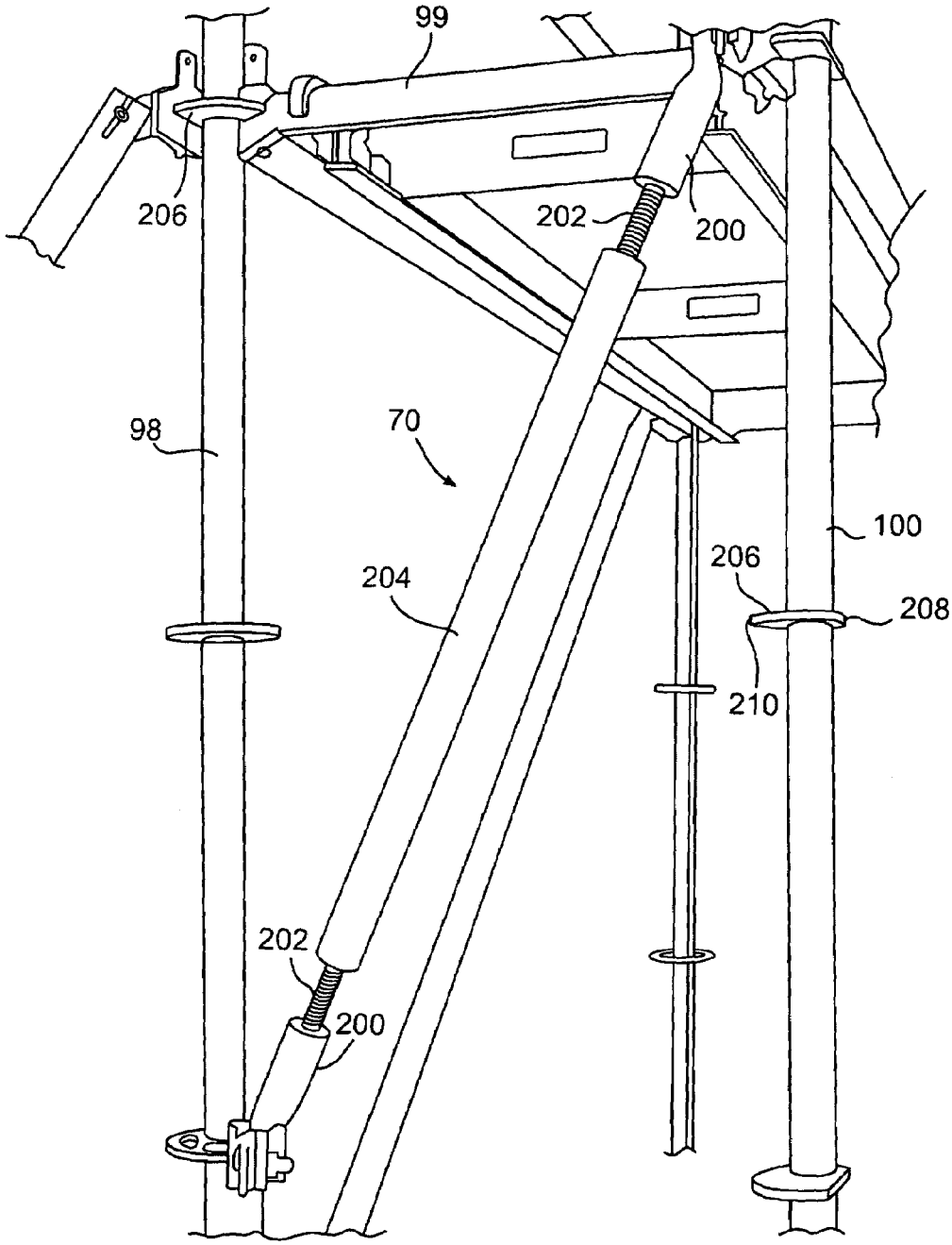
FIG. 4*a* is a perspective view of the diagonal adjustment member of FIG. 4.
Figure 4B:
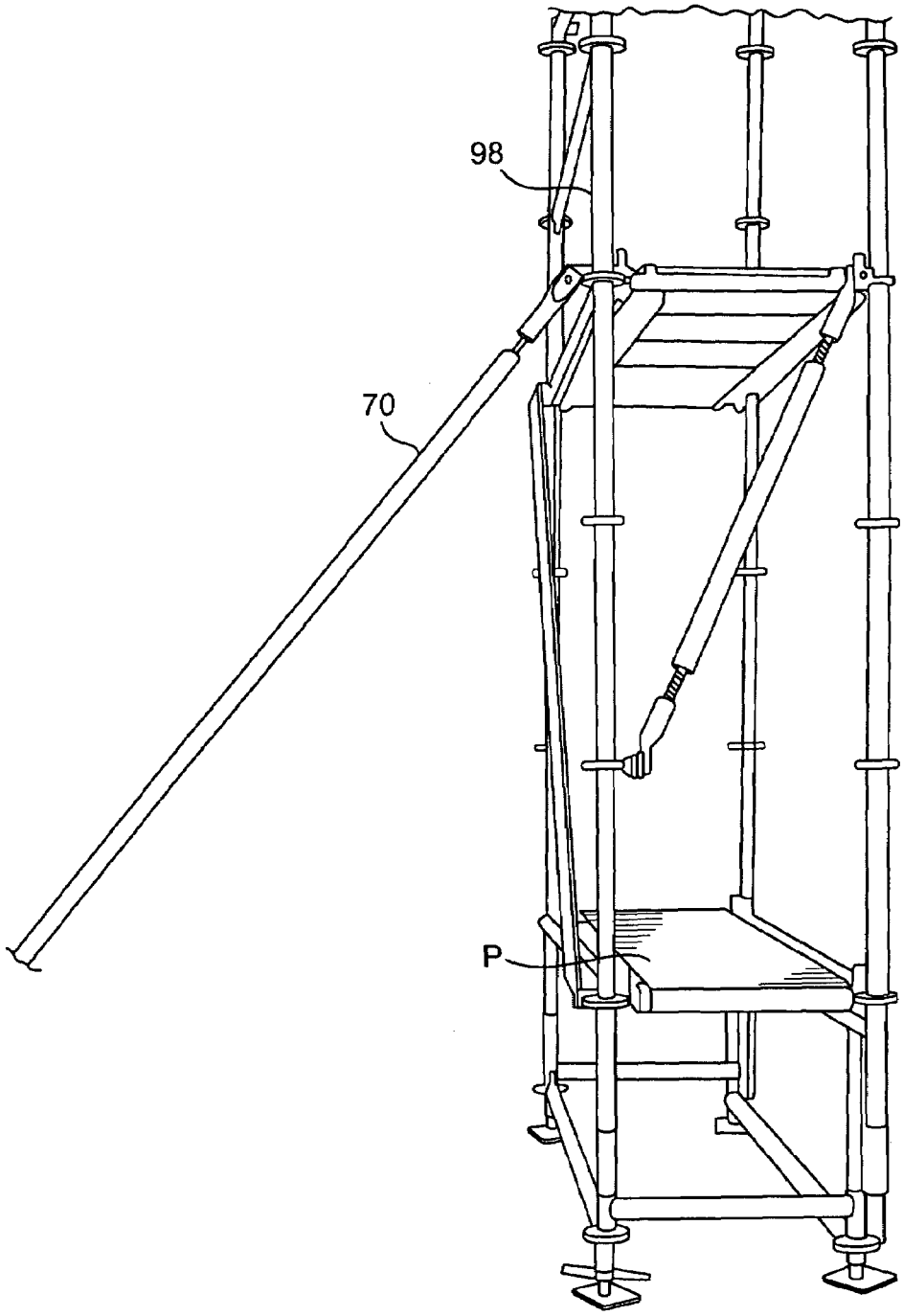
FIG. 4*b* is a perspective view of another embodiment of the diagonal adjustment member of the invention.

In another embodiment of the invention, vertical adjustment members 70 may be disposed diagonally between front and rear scaffolding frame members as shown in FIG. 4 and FIG. 4*a*. Adjustment member 70 then may include screw members 202, 202 fixedly and non-rotatably attached to end mounts 200, 200 respectively. Turn buckle 204 receives screw members 202, 202 in distal end threaded receiving portions, with the threads reversed at one of the threaded receiving portions. In this manner, when turn buckle 204 is rotated along a lengthwise axis, adjustment member 70 lengthens or shortens axially. As end mounts 200, 200 are mechanically fastened to front scaffolding frame member 100 and rear scaffolding frame member 98, respectively, the scaffolding racks with changing length of vertical adjustment member 70. Racking of the scaffolding adjusts the angle of the scaffolding relative to the vertical plane and thus the vertical alignment of the attached ICF wall form. Adjustment member 70 may include a swivel at one end and a screw member and end mount at the other end rather than screw members 202 at each end. This arrangement alleviates the need for reverse threads of one screw member 202. That is to say, the swivel end of member 70 rotates without advancing a screw member, while the screw member end of member 70 rotates to advance a screw member. Referring to FIG. 4*a*, the scaffolding frame may be a system scaffolding frame 100 having interconnection members 206, which connect vertical and horizontal portions of the scaffolding frame together, such as vertical pipe 98 and horizontal pipe 99. As is known in the art interconnection members 206 permit a small amount of angular motion of member 99 relative to member 98, and therefore the above described racking of the scaffolding is facilitated. The interconnection members 206 may be rosettes configured with curved arc portions 210 and leading edge straight portions 208 such that straight portions 208 may be positioned in close proximity to the wall form. One or more additional adjustment members 70 may be disposed between rear scaffolding frame member 98 and the ground, as illustrated in FIG. 4*b*, instead of between front and rear scaffolding frame members as shown in FIG. 4*a*.

Figure 5:
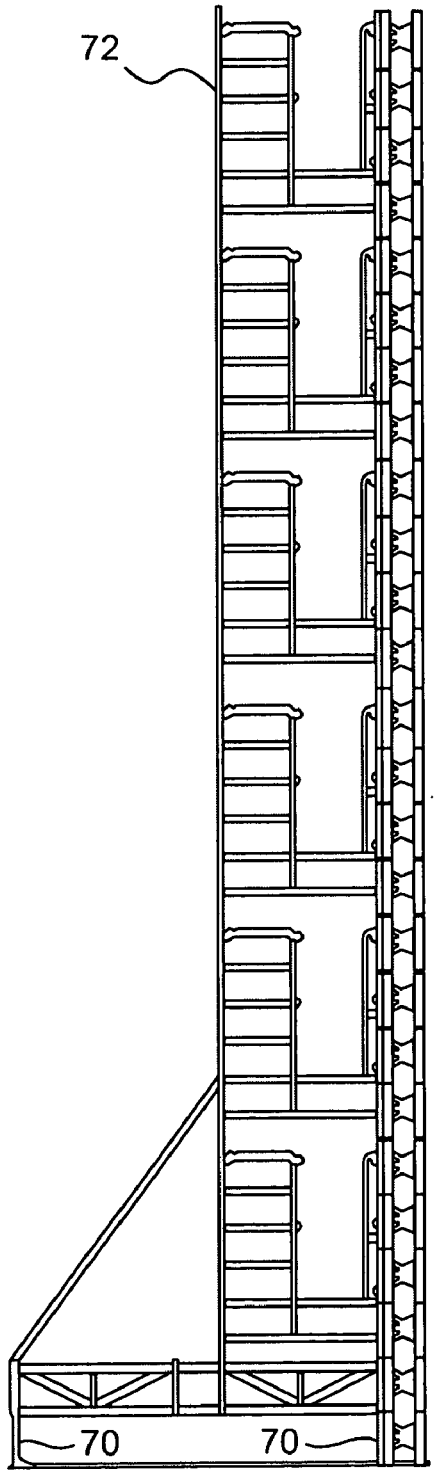
FIG. 5 is a partial cross section view of a wall bracing system made in accordance with the principles of the invention, with open top scaffolding.
Figure 6:
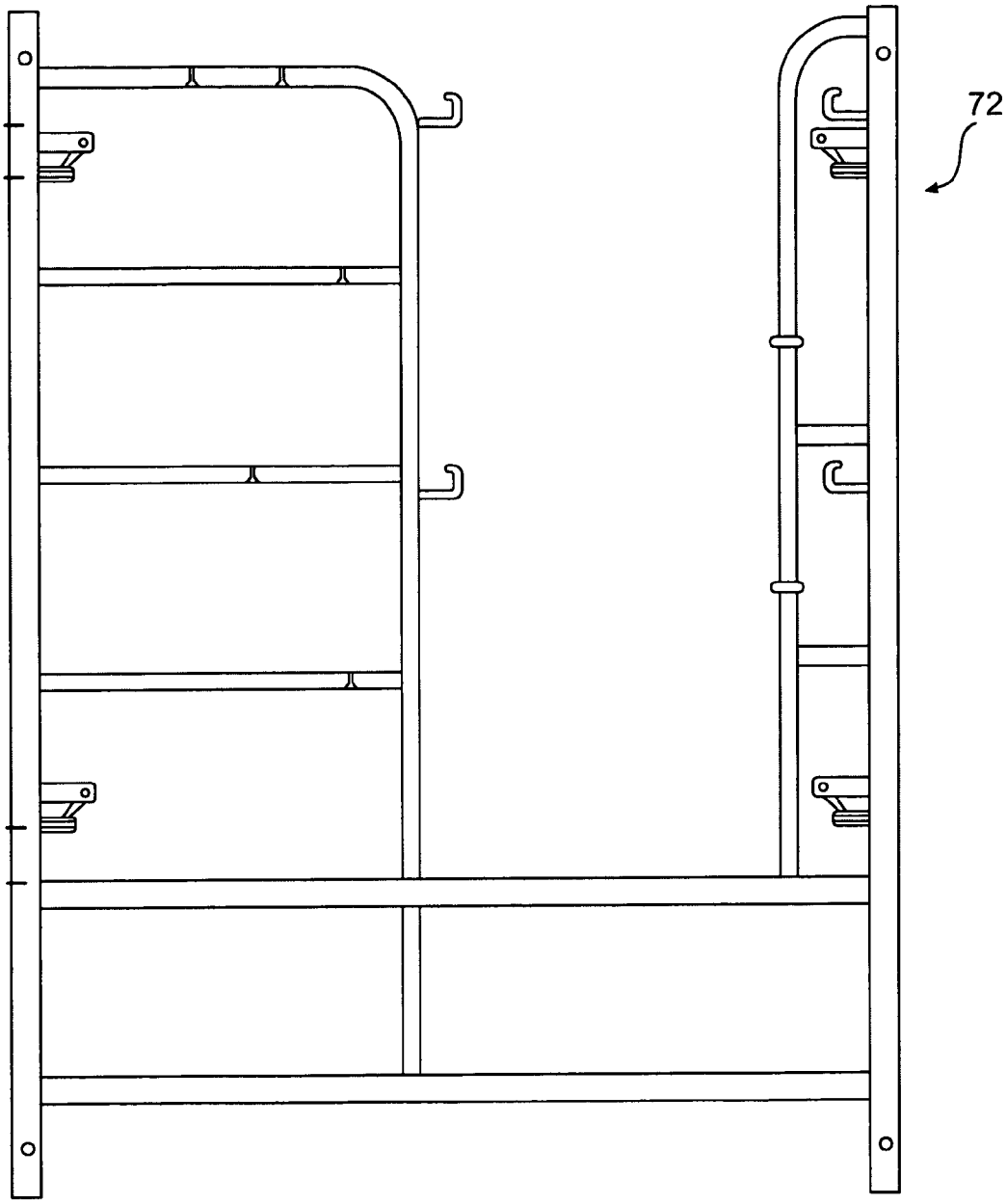
FIG. 6 is a side elevation view of an open top scaffolding frame.

FIG. 5 illustrates an open top scaffolding frame 72 serving as the bracing member of the invention. FIG. 6 illustrates such an open top scaffolding frame in more detail. The open top scaffolding facilitates easy access to the upper most ICF blocks for directing the flow of pourable building material such as concrete into the receiving space between the insulated panels of the ICF wall. Open top scaffolding frame 72 may have vertical adjustment members 70 for adjusting the vertical orientation of the ICF wall as described above.

Figure 6A:
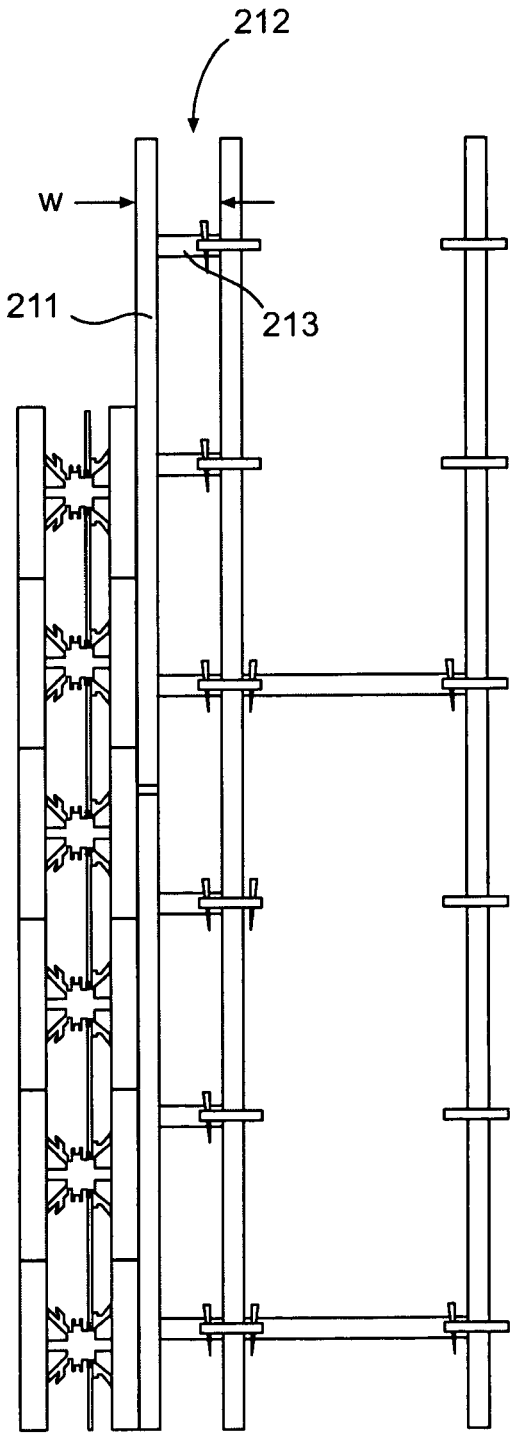
FIG. 6*a* is a partial cross section side elevation view of a scaffolding spacer of the invention.
Figure 6B:
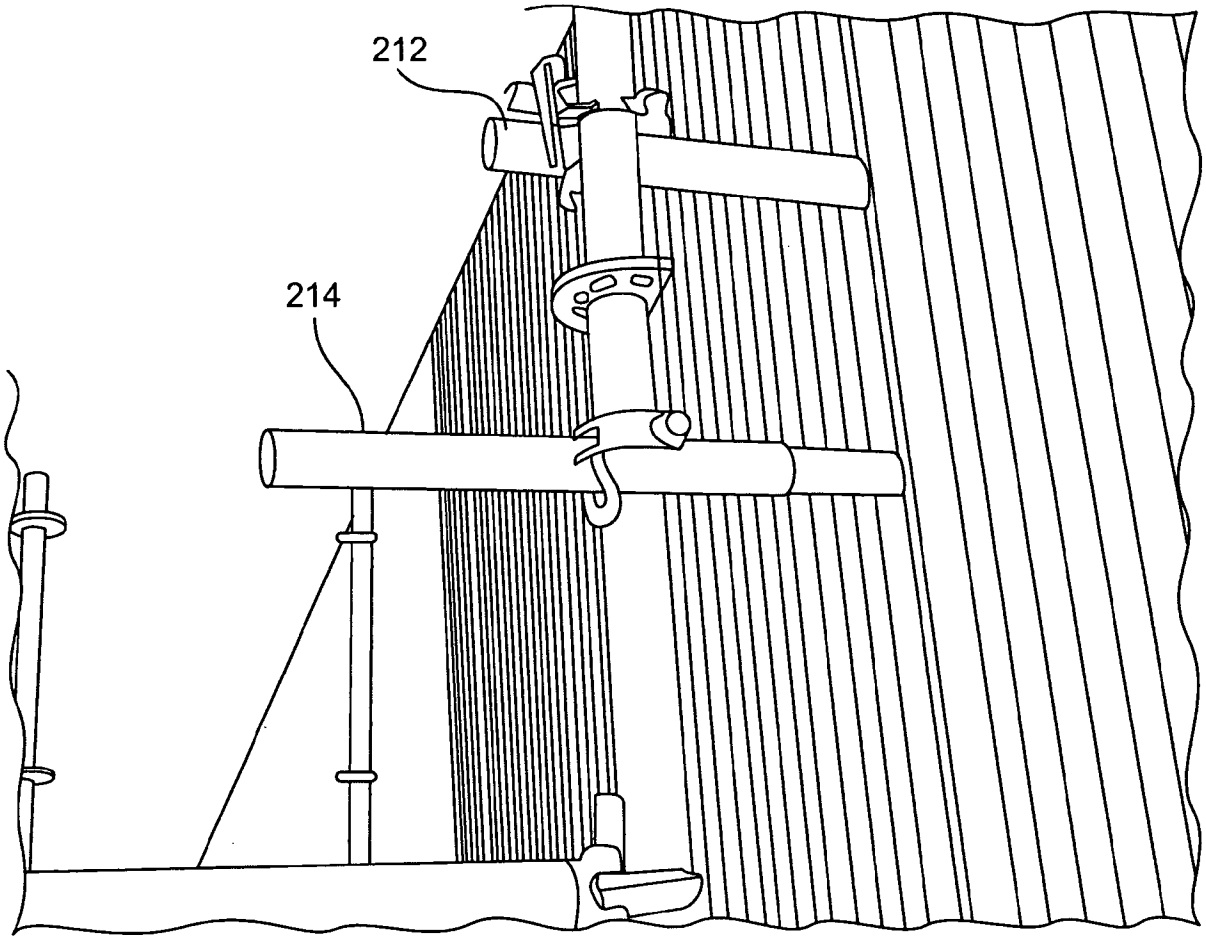
FIG. 6*b* is a perspective view of another embodiment of the scaffolding spacer of the invention.

In another embodiment of the invention illustrated in FIG. 6*a*, a scaffolding spacer 212, which may be approximately 12" in width W, can be attached to the scaffolding such that it is disposed between the ICF wall and the scaffolding. The spacer 212 may consist of one or more vertical pipe members 211 and horizontal pipe members 213 attached thereto and may serve as the bracing member of the invention. The distance between vertical pipe member(s) 211 and the attached scaffolding may be adjustable to align the ICF wall along dimension W. As illustrated in FIG. 6*b*, an adjustable jack 214 may be used to adjust the spacing along dimension W between the ICF wall and scaffolding to align the ICF wall form in a substantially vertical orientation. One or more spacer width adjusting jacks 214 may be used. The spacer 212 may be constructed of system scaffolding components, other scaffolding components, or a combination of welded tubes as described above. After the concrete is poured into the ICF wall form and sets, the spacer may be removed, leaving the scaffolding in place to then serve as a working platform to apply external cladding to the ICF wall.

Figure 7A:
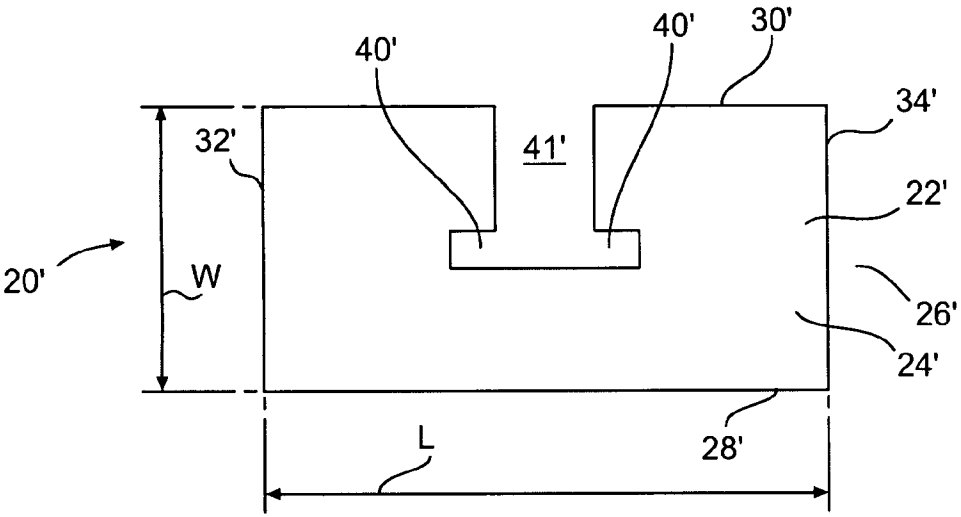
FIGS. 7*a–b* illustrate a second embodiment of the ICF wall bracing system of the invention. More particularly.
Figure 7B:
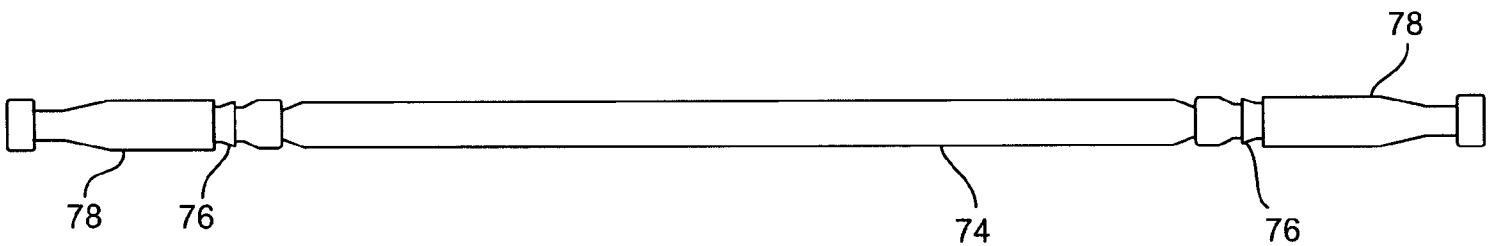

Another embodiment of the anchoring and tensioning members of the invention is shown in FIG. 7*a* and FIG. 7*b*, respectively. Like reference numerals have been used to designate like parts. As with anchor 20, a primary function of anchor 20' is to distribute loads from the bracing system across an inner face 62 of insulating panel 58. As seen in FIG. 7*a*, anchor 20' includes base plate 22'. Plate 22' has front 24', back 26', side edges 32', 34', bottom edge 28' and top edge 30'. Tension member notches 40', 40' may be cut into plate 22' in a central portion thereof to form a T-shaped opening 41'. Anchor 20' is preferably a steel or aluminum alloy plate which may have a length L, a width W, and a thickness T. Typical dimensions for L, W and T may be 6 inches, 3 inches and 0.050 inches respectively. Of course, other dimensions may be used depending upon the particular application and other factors that are readily known to those skilled in the art.

As with the first embodiment of anchor 20, a bracing member 56 is used with this embodiment to keep ICF 68 straight and plumb during construction, and may be selected from any conventional falsework or scaffolding frame. Bracing member 56 is positioned with its inner side against the outer face 60 of insulating panel 58.

After ICF 68 is positioned against bracing member 56, anchor 20' is oriented so that back 26' is flush with inner face 62 of insulating panel 58 and positioned opposite of bracing member 56 in the same manner shown in FIG. 2*c*. In this embodiment, the tension member may take the form of a strap 74 as illustrated in FIG. 7*b*, which may be formed from plastic, metal, wire or other suitable material. To attach the system together, a central portion of tension member 74 is disposed around an outer periphery of bracing member 56, with anchor portions 78, 78 are passed through holes cut through insulating panel 58, and through tension member notches 40', 40'. Anchor portions 78, 78 at the ends of the strap are lead through tension members notches 40', 40' and tensioned such that a respective one of barbs 76, 76 engage front 24' of plate 22' in an area adjacent to a respective one of notches 40', 40', thus drawing bracing member 56 snug (preferably flush) against the outer face 60 of insulating panel 58 and drawing anchor 20' snug (preferably flush) against inner face 62 of insulating panel 58. Anchor portions 78, 78 extend inward from front 24' into the cavity between insulating panels 58, 59 which will receive the pourable building material for assisting in fixing the system in place once the concrete sets. Again, instead of cutting holes in panel 58, a central portion of strap 74 may be disposed around an outer bracing member 56, with anchor portions 78, 78 passing through an interface 218 between upper and lower insulating panels 58 of upper and lower ICF blocks, and through tension member notches 40', 40'.

Figure 8A:
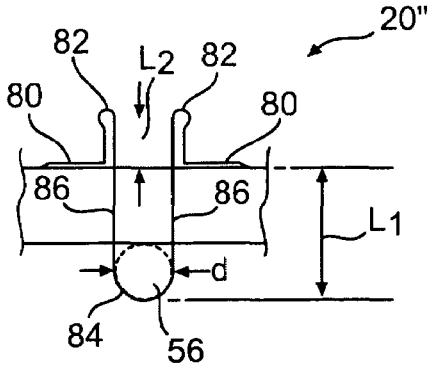
FIGS. 8*a–c* illustrate a third embodiment of the ICF wall bracing system of the invention, in which the anchoring and tensioning members are integrally formed from wire-like material. More particularly.
Figure 8B:
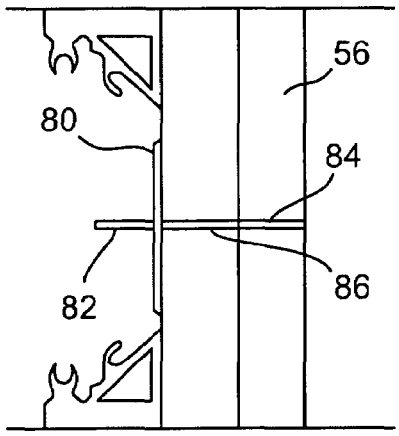
Figure 8C:
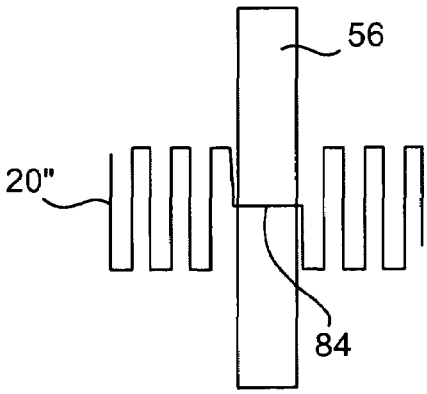

Yet another embodiment of the invention is shown in FIG. 8*a*, FIG. 8*b* and FIG. 8*c*, in which the anchoring and tensioning members are formed integrally in a single part 20", which is preferably formed as a steel or aluminum alloy wire or rod and may have a diameter of about 0.125 inches. Again, one of the primary functions of combination part anchoring and tensioning member 20" is to distribute loads from the bracing system across an inner face 62 of insulating panel 58. As seen best in FIG. 8*a*, part 20" includes portions that will be adjacent the insulating panel, the concrete wall, the bracing member, and the interface joint between upper and lower form blocks and are referred to respectively as insulating panel interface portion 80, concrete interface portion 82, bracing member interface portion 84, and panel joint portion 86.

After ICF 68 is positioned against bracing member 56, part 20" is disposed such that bracing member interface portion 84 surrounds the outer perimeter of bracing member 56, panel joint portions 86, 86 traverse the interface joint 218 between upper and lower insulating panels 58 of upper and lower ICF blocks, insulating panel interface portions 80, 80 lie against, preferably flush with, inner face 62 of insulating panel 58, and concrete interface portions 82, 82 extend into a concrete receiving space of the ICF wall for assisting in fixing the system in place once the concrete sets. Interface portions 80, 80 may extend horizontally along inner face 62 of panel 58 in a step-wise manner as shown in FIG. 8*c*, thus distributing work loads across inner face 62. The dimensions of part 20" are sized such that bracing member 56 is drawn snug, preferably flush, against the outer face 60 of insulating panel 58.

In particular, the distance between panel portion 80 and the outer surface of bracing portion 84 is $L_1$, concrete interface portion 82 has a length $L_2$ and bracing member interface portion 84 forms a semicircle having diameter d. Typical dimensions for $L_2$ and d may be 2 inches each and $L_1$ may be 4½ inches. Of course, other dimensions may be used depending upon the particular application and other factors that are readily known to those skilled in the art.

Figure 9:
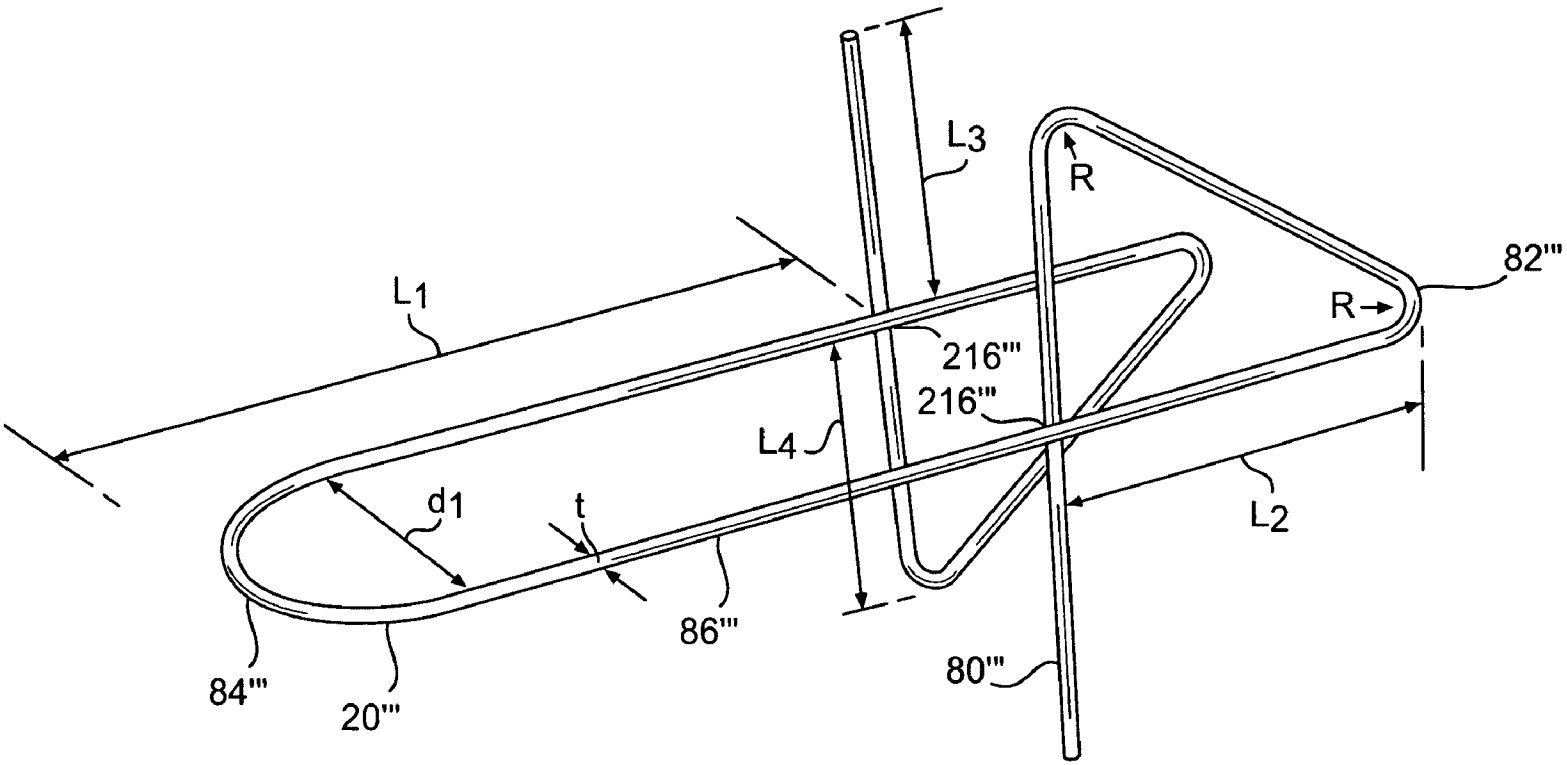
FIG. 9 is a perspective view of a fourth embodiment of the invention illustrating an integral anchoring and tensioning member formed as a wire clip.

FIG. 9 illustrates another embodiment of a combination anchor and tensioning member 20''', preferably formed into a clip from a metal wire or rod, which functions in a similar manner as the embodiment of FIGS. 8*a*–*c*. In this embodiment however, the panel interface portion 80''' extends vertically instead of vertically and horizontally as in the FIG. 8*a*–*c* embodiment. Moreover, panel interface portion 80''' may be fixedly attached at the end of panel joint interface portion 86''' at 216''' by welding or other means known in the art to increase the ability of member 20''' to resist deformation when bracing member 56 supports and aligns the ICF wall. Combination anchor and tensioning member 20''' is preferably formed as a steel or aluminum alloy wire or rod having a thickness t of about ⅛" and having dimensions $L_1$, $L_2$, $L_3$, $L_4$ and $d_1$ and radius of curvature R, as illustrated in FIG. 9. Typical dimensions for $L_1$, $L_2$, $L_3$, $L_4$ and $d_1$ and R may be 4½ inches, 2⅝ inches, 2 inches, 2 inches, 2⅛ inches and ⅛ inch respectively. Of course, other dimensions may be used depending upon the particular application and other factors that are readily known to those skilled in the art.

According to another aspect of the invention, a method of temporarily bracing an insulated wall form is provided. First, an anchoring member, such as 20, 20', 20", 20''' previously described, is provided within the ICF wall to attach the wall to falsework or scaffolding during construction.

A bracing member 56 such as a scaffolding frame is positioned with its inner side against the outer face 60 of insulating panel 58.

After bracing member 56 is positioned against ICF 68, the anchor is oriented so that its back is flush with inner face 62 of insulating panel 58 and positioned opposite of bracing member 56. A separate or integrally formed tension member, as described above, is then connected to or around the bracing member to draw the anchor snugly (preferably flush) against the insulating panel as described previously.

The vertical alignment of the scaffolding or spacer members and the ICF wall may then be adjusted by adjusting vertical alignment members previously described herein, and the concrete or other pourable building material may be poured into the concrete receiving space of the ICF wall. The height of the fluid concrete column received in the ICF wall is limited by the strength of the ICF wall, as the hydrostatic load of the concrete column will strain the ICF wall. A typical height for a first column of fluid concrete is approximately 11 feet, which may be placed in 3 foot lifts.

Figure 10:
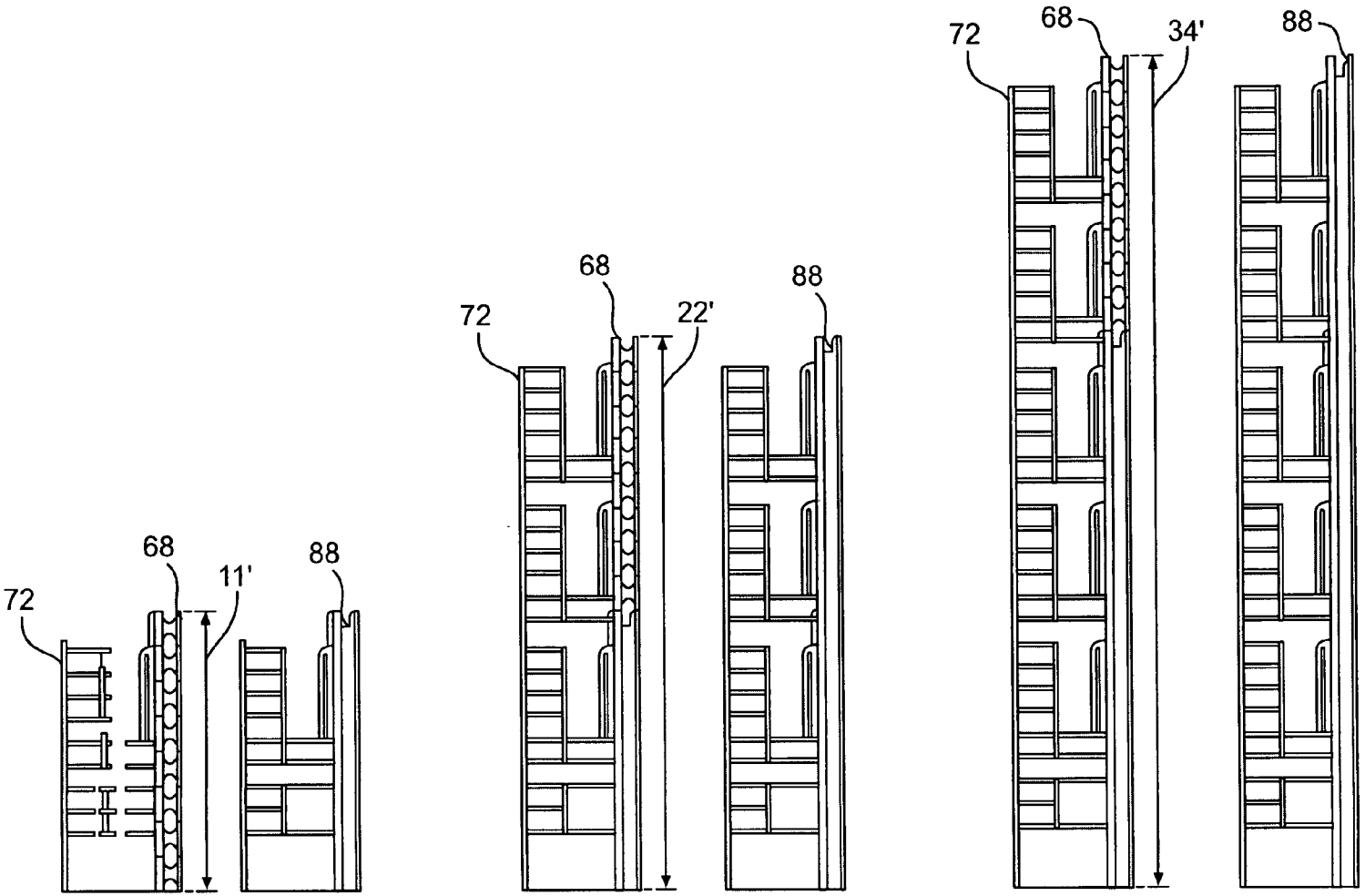
FIG. 10 is a partial cross section view of a wall bracing system made in accordance with the principles of the invention, illustrating use of the invention in constructing a tall wall in stages.

Upon substantial setting of the first concrete pour, additional scaffolding and ICF wall blocks may be joined to the first scaffolding frame and ICF wall, extending the scaffolding and ICF wall vertically upwards in stages as shown schematically in FIG. 10. The additional scaffolding and ICF wall may then be joined together as discussed above with respect to the joining of the first scaffolding frame and ICF wall. Of course the additional scaffolding and ICF wall may then be vertically aligned by adjusting the vertical adjustment members or spacer members, then an additional column of concrete may be poured to a total height of approximately 22 feet. Upon setting of the additional concrete, the process may be repeated a third time or more times.

Although the foregoing description is directed to the preferred embodiments of the invention, it is noted that other variations and modifications will be apparent to those skilled in the art, and may be made without departing from the spirit or scope of the invention.

What is claimed is:

1. A system for temporarily bracing an insulated wall form comprising:

an insulated wall form having generally parallel spaced panels defining therebetween a cavity for receiving pourable building material, at least one of said panels being formed from foam insulating material having outside and inside faces;

a bracing member disposed adjacent to the outside face of the insulating panel and adapted to support the insulated wall form; and a tensioner having a first portion disposed against a portion of the inside face of said at least one insulating panel, a second portion comprising a flexible member securing the bracing member and the insulating panel together to align and brace the wall form, and wherein said tensioner terminates within said cavity such that no portion thereof extends all the way across said cavity to the other of said spaced panels.

2. The system of claim 1, wherein said first portion of the tensioner comprises an anchoring member having a first section disposed against said portion of the inside face of the insulating panel and a second section disposed to be set in pourable building material received in the insulated wall form.

3. The system of claim 2, wherein said anchoring member comprises a plate including a flat portion defining said first section and a projection defining said second section.

4. The system of claim 1, wherein said flexible member extends through openings in the insulating panel.

5. The system of claim 1, wherein said insulated wall form comprises upper and lower form blocks and said flexible member extends through an interface between the form blocks.

6. The system of claim 1, wherein said first portion of the tensioner lies flush against said portion of the inside face of said at least one insulating panel with no intervening members disposed therebetween.

7. The system of claim 1, wherein said second portion of the tensioner is disposed to be partially set in pourable building material received in the wall form.

8. The system of claim 1, wherein said first portion of the tensioner comprises a plate having at least one section configured to engage said flexible member.

9. The system of claim 1, wherein said first and second portions of said tensioner comprise portions of said flexible member and further including a third portion disposed to be set in pourable building material received in the wall form.

10. The system of claim 9, wherein said second portion extends through the insulated wall form and around said bracing member.

11. The system of claim 10, wherein the insulated wall form includes upper and lower form blocks and said second portion extends through an interface between the form blocks.

12. The system of claim 9, wherein said first, second and third portions of said tensioner comprise a single component.

13. The system of claim 9, wherein said first portion of said tensioner extends generally horizontally along said portion of said inside face of said at least one insulating panel.

14. The system of claim 9, wherein said first portion of said tensioner extends generally vertically along said portion of said inside face of said at least one insulating panel.

15. The system of claim 12, wherein said single component comprises a single piece of bent wire.

16. The system of claim 15, wherein portions of said wire are fixedly attached together to resist deformation when said bracing member supports and aligns the wall form.

17. The system of claim 1, wherein said bracing member comprises a scaffolding frame.

18. The system of claim 1, wherein said bracing member comprises a scaffolding attachment member disposed between the insulated wall form and a scaffolding frame.

19. The system of claim 18, wherein the scaffolding attachment member is movable to align the wall form vertically.

20. The system of claim 1, wherein the bracing member comprises a system scaffold having interconnection members configured to allow positioning of a leading edge of the system scaffold to be in close proximity to the outside face.

21. The system of claim 20, wherein said interconnection members comprise rosettes having perimeters that define a curved arc portion and a straight portion, said straight portion being disposed adjacent to the outside face.

22. The system of claim 17, wherein said scaffolding frame comprises one of system scaffolding, frame scaffolding and open-top scaffolding.

23. The system of claim 1, wherein the foam insulating material comprises expanded polystyrene.

24. A method of temporarily bracing an insulated wall form, said method comprising the steps of:

positioning a first bracing member adjacent to an outer face of a first insulated wall form having generally parallel spaced panels at least one of which is formed from insulating material;

positioning an interface member adjacent to an inner face of the first insulated wall form;

disposing a tension member between the first bracing member and the interface member;

positioning a portion of one of the interface and tension members to be set in pourable building material received in the wall form; and tensioning the tension member to secure the interface member, wall form and bracing member together to align and brace the wall form.

25. The method of claim 24, wherein said tensioning step comprises securing the ends of the tension member in a position maintaining the tension between the interface member and bracing member.

26. The method of claim 25, wherein said tensioning step comprises securing the ends of the tension member together.

27. The method of claim 25, wherein said tensioning step comprises securing the ends of the tension member to the interface member.

28. The method of claim 24, further comprising the step of positioning the tension member through at least one opening in the insulated wall form.

29. The method of claim 24, wherein the insulated wall form includes upper and lower form blocks having an interface therebetween and further comprising the step of positioning the tension member through the interface between upper and lower insulated wall form blocks.

30. The method of claim 24, wherein the interface member and the tension member are integrally formed as a single piece and said steps of positioning the interface member, disposing the tension member, positioning a portion of one of interface and tension members, and tensioning the tension member comprise manipulating said single piece between the inner face of the wall form and the bracing member.

31. The method of claim 24, further including the steps of:

aligning the first wall form in a substantially vertical orientation;

filling the first wall form with a pourable building material;

allowing the pourable building material to substantially set;

positioning a second wall form on top of the first wall form;

positioning a second bracing member above and connecting the second bracing member to the first bracing member;

positioning a second interface member adjacent to an inner face of the second wall form opposite the second bracing member;

disposing a second tension member between the second bracing member and the second interface member to secure the second bracing member to the second wall form; and aligning the second wall form in substantially a vertical direction.

32. A system for temporarily bracing an insulated wall form comprising:

an insulated wall form having generally parallel spaced panels, at least one of which is formed from foam insulating material having outside and inside faces;

a bracing member forming at least part of a scaffolding frame disposed adjacent to the outside face of the insulating panel and adapted to support the insulated wall form, said scaffolding frame comprising one of system scaffolding, frame scaffolding and open-top scaffolding; and a tensioner having a first portion disposed against a portion of the inside face of said at least one insulating panel and a second portion securing the bracing member and the insulating panel together to align and brace the wall form.

33. The system of claim 32, wherein no portion of said tensioner extends to the other of said spaced panels.

34. The system of claim 1, wherein the inner face is oriented towards said cavity.

35. A system for temporarily bracing an insulated wall form comprising:

an insulated wall form having generally parallel spaced panels defining therebetween a cavity for receiving pourable building material, at least one of said panels being formed from foam insulating material having outside and inside faces;

a bracing member comprising a scaffolding frame including a portion disposed adjacent to the outside face of the insulating panel and adapted to support the insulated wall form;

an alignment member disposed in said scaffolding frame for adjusting the vertical alignment of the insulated wall form; and a tensioner having a first portion disposed against a portion of the inside face of said at least one insulating panel, and a second portion securing said portion of the scaffolding frame and the insulating panel together to align and brace the wall form.

36. The system of claim 35, wherein said alignment member is disposed diagonally in said scaffolding frame.

37. The system of claim 35, wherein said alignment member is spaced from said scaffolding frame to allow adjustment without interference from the wall form.

* * * * *